United States Patent [19]

Klawitter

[11] Patent Number: 4,504,072

[45] Date of Patent: Mar. 12, 1985

[54] ADJUSTABLE SKATE FASTENER

[75] Inventor: Ronald R. Klawitter, Hermann, Mo.

[73] Assignee: Handi-Pac, Inc., Hermann, Mo.

[21] Appl. No.: 455,103

[22] Filed: Jan. 3, 1983

[51] Int. Cl.[3] ..... A63C 1/04

[52] U.S. Cl. ..... 280/11.31; 24/70 SK; 24/71 SK

[58] Field of Search ..... 280/11.31, 11.32, 11.33, 280/11.34; 24/68 SK, 70 SK, 71 SK

[56] References Cited

U.S. PATENT DOCUMENTS 1,003,907 9/1911 Hoffmann ..... 24/68 B 1,280,505 10/1918 Lowe ..... 280/11.31

2,722,430 11/1955 Owsen et al. ..... 280/11.31

FOREIGN PATENT DOCUMENTS 716965 8/1965 Canada .

*Primary Examiner*—Joseph F. Peters, Jr.

*Assistant Examiner*—Michael Mar

*Attorney, Agent, or Firm*—Polster, Polster and Lucchesi

[57] ABSTRACT

An improved skate fastener assembly including an arrangement to permit preselected positioning and limited inward and outward movement of the shoe-engaging portions of a skate fastener assembly.

4 Claims, 2 Drawing Figures

ADJUSTABLE SKATE FASTENER

BACKGROUND OF THE INVENTION

The present invention relates to skates of various types and more particularly to an adjustable shoe toe clamp for roller skates and the like.

It is known in the art to provide adjustable shoe toe clamps which utilize opposed shoe fastener members that are spring biased into preselected position against opposed shoe frame sides when a skater's foot is removed from a skate (U.S. Pat. No. 3,279,808). However, these past toe clamp assemblies have been fairly complex in the manufacture and assembly, have potential problems with uneven wear and uneven positioning and do not insure against loss of shoe fastener members when the toe is disengaged from the skate.

The present invention, recognizing these problems of the past and resolving the same, provides a quickly adjustable shoe toe clamp assembly which can be adjusted for various sizes with a minimum of effort and parts, which does not require separate tools or keys, which readily accommodates for wear and balance, and which minimizes the changes for loss and misplacement of the few parts involved. Further, the present invention provides a shoe fastener assembly which can be readily and economically constructed, which reduces the chances of wear and misalignment of the several parts, which can be economically constructed and assembled with a minimum of steps and materials and yet permits a firm, balanced shoe hold in any one of several readily selectable positions, despite inevitable problems of wear which are likely to occur as a consequence of frequent usage.

It is to be understood that various changes can be made in the arrangement, form and construction of the apparatus disclosed by one skilled in the art without departing from the scope or spirit of the present invention.

BRIEF SUMMARY OF THE INVENTION

In accordance with this invention, generally stated, the present invention provides an improved adjustable shoe fastener assembly for roller skates and the like, comprising: a sole plate having downwardly extending flanges with elongated slots disposed therein at opposite sides of the plate; a pair of opposed shoe fastener members mounted on the sole plate, each fastener member including an outer upwardly and forwardly inwardly angled shoe engaging portion and an inwardly directed blade portion passing through one of the flange slots, each blade having an elongated slot disposed therein with a rack of teeth in the side of the slot adjacent the toe of the sole plate; a rivet pin fixed to the sole plate to extend downwardly through the slots of the blade portions; a wire spring clip having a central loop nestingly clipped to the pin on the side away from the sole plate toe, the clip being bent back upon itself to provide V-shaped resilient arms on either side of the central loop, the ends of the arms being turned at right angles to grip the blade side adjacent the sole plate toe to bias the racks of teeth on the blades into firm but yieldable engagement with the pin at a preselected position.

BRIEF DESCRIPTION OF THE DRAWINGS

Referring now to the drawings.

DESCRIPTION OF THE PREFERRED EMBODIMENT

Figure 1:
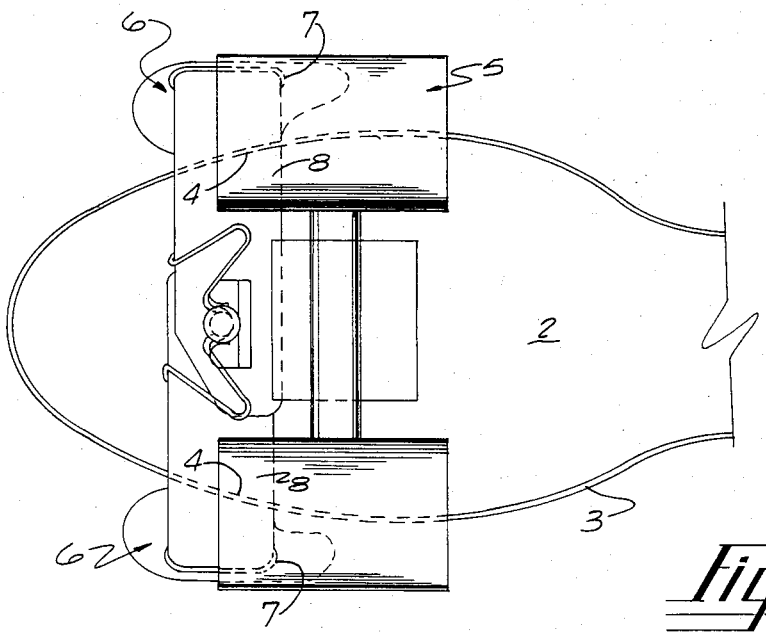
FIG. 1 is a plan view of the underside of a toe portion of a skate incorporating the novel shoe fastener assembly.

As can be seen in FIG. 1 of the drawings, the underside of the toe portion of a roller skate 1 is disclosed. It is to be understood that the part of the skate not shown in the drawings can be of conventional construction to include a heel plate, an ankle strap, a usual wheel frame and rear wheels similar to the wheel frame and front wheels 5 broadly disclosed in FIG. 1. The toe portion of sole plate 2 of skate 1 is provided with downwardly extending flanges 3 which can be integral with the sole plate and which include elongated slots 4 disposed therein at opposite sides of plate 2. Mounted on sole plate 2 is a pair of opposed shoe fastener members 6. Each member 6 includes an outer upwardly and forwardly inwardly angled shoe engaging portion 7 which is adapted to engage the toe of a skater's shoe at each side in a manner known in the art. Each member 6 further includes an inboardly directed blade portion 8, each passing through one of slots 4 of flange 3 so that the blade portions 8 overlap on the underside of sole plate 2.

Figure 2:
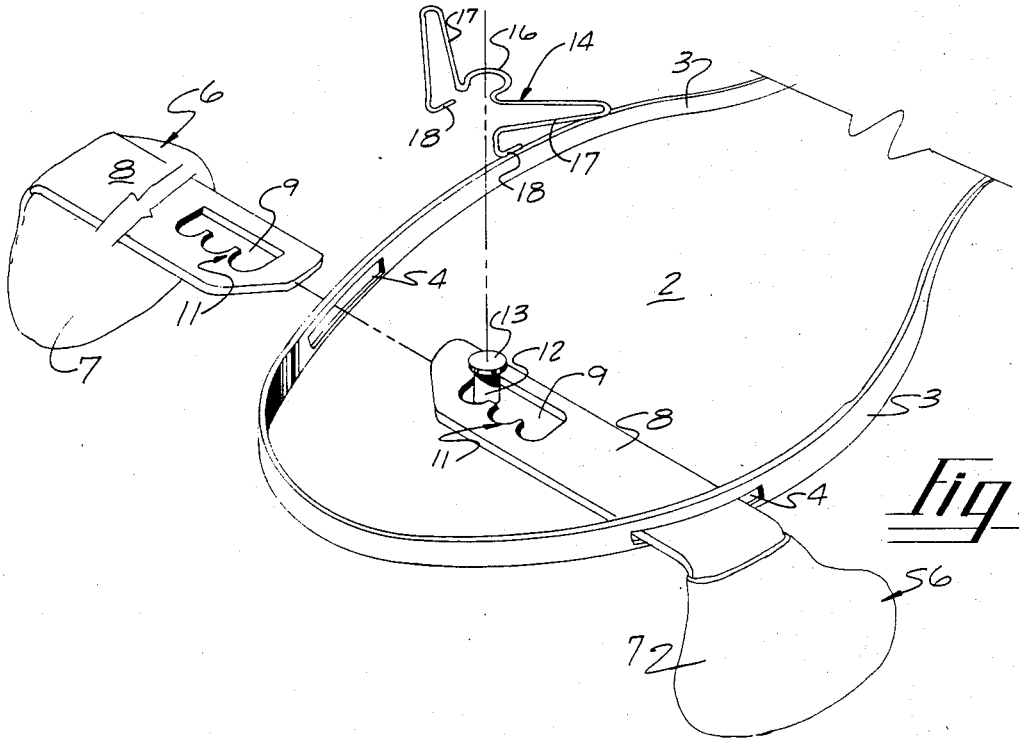
FIG. 2 is an exploded fragmentary perspective view of the toe portion of the skate of FIG. 1, taken from the underside of the skate with the wheel assembly removed for purposes of better illustration.

As can be seen in FIG. 2 of the drawings, each blade portion 8 is provided with an elongated slot 9 with each slot 9 having a rack of teeth 11 disposed therein on the forward side of the slot adjacent the toe of sole plate 2. A rivet pin or detent 12 fixed to plate 2 is arranged to extend downwardly through slots 9 of blade portions 8 and is sized to be engaged snugly by any one of the valleys of the teeth racks 11 when shoe fastener members 6 have been selectively positioned by the skater, the slots 9 being of sufficient breadth, with respect to the diameter of pin 12, to permit limited inward and outward movement of blades 8 extending through slots 4. It is to be understood by one skilled in the art that various teeth and pin arrangements can be utilized without departing from the scope or spirit of the present invention. It is further to be understood that pin 12 can be provided with a head 13 which can be sized with respect to blade slots 9 and teeth 11 to insure that pin 12 cannot be readily disengaged from slots 9.

As can also be seen in FIG. 2 of the drawings, the novel skate fastener assembly further includes a wire spring clip 14 which can be made from any one of a number of suitable resilient materials such as stainless steel. Spring clip 14 is shaped or formed to include a central loop 16 which is sized to be nestingly clipped to rivet pin 12 on the side away from the toe of sole plate 2. Clip 14 is formed bent back upon itself to provide V-shaped resilient arms 17 on either side of central loop 16. The ends of arms 17 are turned at substantially right angles to the plane of the upper surface of the blades 8, and rearwardly at another approximate right angle to provide a hook at 18. Accordingly, when clip 14 is positioned in the assembly so that central loop portion 16 nests with pin 12, the turned ends 18 grip the front edges of blades 8 adjacent the sole plate toe to bias the teeth racks 11 so that one of the several valleys in each rack 11 firmly and snugly engages with pin 12 when the shoe fastener member has been moved inwardly or outwardly to a preselected position to hold the blade in its preselected position even when a skater's toe is removed from the shoe-engaging portions 7 of the shoe fastener assemblies 6.

Numerous variations in the construction of the shoe fastener assemblies of this invention, within the scope of the appended claims, will occur to those skilled in the art in the light of the foregoing disclosure. It is to be noted that the construction of shoe fastener assemblies of this invention permits independent adjustment of the two blades.

I claim:

1. An improved adjustable shoe fastener assembly for roller skates and the like, comprising: a sole plate having downwardly extending flanges with elongated slots disposed therein at opposite sides of said plate; a pair of opposed shoe fastener members mounted on said sole plate, each fastener member including an outer upwardly and forwardly inwardly angled shoe-engaging portion and an inboardly directed blade portion passing through one of the flange slots, each blade having an elongated slot disposed therein; detent means mounted on said sole plate to extend downwardly through each slot; racked tooth means cooperatively disposed adjacent said detent means in the forward part of each of said slots to permit preselected positioning and limited inward and outward movement of said blade portions and the shoe-engaging portions associated therewith; and spring biasing means cooperating with said blade portions to bias said blade portions rearwardly toward said detent means yieldably to retain said racked tooth means in preselected position with said detent means, said detent means comprising downwardly extending pin means, each elongated blade slot having a rack of teeth disposed therein along one side, said spring means yieldably urging said rack into engagement with said pin means in a preselected tooth position.

2. The apparatus of claim 1, wherein the flange slots are of sufficient depth to permit said inwardly directly blade portions to overlap, said downwardly extending pin means passing through the ovelapped slots of said blades.

3. The apparatus of claim 1, wherein the flange slots are of sufficient depth to permit said inwardly directed blade portions to overlap, said downwardly extending pin means passing through the overlapped slots of said blades, said spring biasing means comprising a wire spring-clip having a central loop engaging said pin and having V-shaped resilient arms on either side of said loop which are turned at their ends to provide hooks to grip the forward edges of said blades to bias the racked tooth means and pin into yieldable engagement at a preselected position.

4. An improved adjustable shoe fastener assembly for roller skates and the like, comprising: a sole plate having downwardly extending flanges with elongated slots disposed therein at opposite sides of said plate; a pair of opposed shoe fastener members mounted on said sole plate, each fastener member including an outer upwardly and forwardly inwardly angled shoe engaging portion and an inboardly directed blade portion passing through one of said flange slots, each blade having an elongated slot disposed therein; said flange slots being of sufficient depth to permit said inboardly directed blade portions to overlap; a rivet pin fixed to said sole plate to extend downwardly through the slots of said blade portions, said blade slots each having a rack of teeth in the forward side thereof adjacent the toe of said sole plate; a wire spring clip having a central loop nestingly clipped to said pin on the side of said pin away from said sole plate toe, said spring clip being provided with V-shaped resilient arms on either side of said loop which are turned at their ends to provide a hook to grip the forward edges of said blades adjacent the toe of said sole plate to bias the racks of teeth on said blades into yieldable engagement with said pin at a preselected position.

* * * * *